US005358790A

United States Patent [19]

Rüf et al.

[11] Patent Number: 5,358,790

[45] Date of Patent: Oct. 25, 1994

[54] METHOD FOR REDUCING THE WATER VAPOUR PERMEABILITY OF PAPER

[75] Inventors: Walter Rüf, Wolfsberg; Josef Bachler, St. Gertraud, both of Austria

[73] Assignee: Patria Papier & Zellstoff AG Frantschach, St. Gertraud i.L., Austria

[21] Appl. No.: 792,948

[22] Filed: Nov. 15, 1991

[30] Foreign Application Priority Data

Nov. 19, 1990 [AT] Austria ..... A2337/90
Feb. 8, 1991 [AT] Austria ..... A279/91

[51] Int. Cl.[5] ..... B32B 9/06

[52] U.S. Cl. ..... 428/486; 106/218; 106/230; 427/391; 427/393.4; 427/411; 428/498; 428/500

[58] Field of Search ..... 427/391, 393.4, 411; 106/218, 230; 428/486, 498, 500

[56] References Cited

U.S. PATENT DOCUMENTS

| | | | |
|---|---|---|---|
| 2,251,296 | 8/1941 | Shipp | 427/411 X |
| 2,369,450 | 2/1945 | Fisher et al. | 427/411 X |
| 3,507,685 | 4/1970 | Banerjee | 427/391 X |
| 3,682,696 | 8/1972 | Yasuda et al. | 162/158 X |
| 3,707,393 | 12/1972 | McDonald | 427/411 X |
| 5,192,363 | 3/1993 | Bussell et al. | 162/180 X |

FOREIGN PATENT DOCUMENTS 393451 10/1990 European Pat. Off. .

*Primary Examiner*—Michael Lusignan
*Attorney, Agent, or Firm*—Collard & Roe

[57] ABSTRACT

The invention relates to a method of reducing the water vapor permeability of a sheet of paper, which comprises the step of coating the paper sheet with a film of 5–30 g/sq.m. of a coating medium consisting of a rosin sizing dispersion containing additives improving the film-forming properties of the coating medium, which additives include surfactants and waxes. It also deals with a paper so produced.

14 Claims, No Drawings

METHOD FOR REDUCING THE WATER VAPOUR PERMEABILITY OF PAPER

BACKGROUND OF THE INVENTION

1. Field of the Invention

The invention relates to a method for reducing the water vapour permeability of paper, paperboard or the like, in which the paper is coated with a coating material. In the following description the comprehensive term paper shall also include paperboard, cardboard or similar fibre fleeces.

It is known to make paper resistant to water vapour by coating. Thus a polyethylene foil is laminated onto the paper or a coat of PVC or PVDC coating material is applied. The recycling of PE-laminated paper is extremely difficult. On the other hand, when PVC or PVDC-coated papers are burnt, hydrochloric acid and, under certain circumstances, dioxines might be formed.

SUMMARY OF THE INVENTION

It is the object of the present invention to manufacture paper resistant to water vapour which can be completely recycled and which consists of toxicologically and biologically completely harmless components and which is, in particular, free from chlorine.

The production of such paper is achieved in that the coating medium is formed by a free-rosin sizing dispersion, which contains additives for improving the film-forming properties, these being, amongst others, surfactants or waxes, as well as preferably further additives.

The raw material for manufacturing the rosin size is divided into three different basic types depending on the method it is obtained, which are: wood rosin, balsamic rosin and liquid rosin. The main components of the rosins which are interesting in this respect are rosin acids, of which the most important are:

abietic acid,
levopimaric acid,
palustric acid,
dehydroabietic acid,
dihydroabietic acid,
tetrahydroabietic acid
pimaric acid,
isopimaric acid.

In order to manufacture sizes from the rosins, the crude rosin is usually "strengthened", i.e. 8–13% maleic anhydride or fumaric acid are added to the rosin at approx. 200° C. The rosins are then dispersed in water, casein being generally used as protective colloid to stabilize the dispersion. It is, however, also possible to use unstrengthened rosin sizes within the scope of the invention.

All commercially available rosin sizing dispersions, such as Saccocell H 301 or H 309 from Krems Chemie AG, are suitable for the invention.

It has proved to be particularly beneficial if surfactants or waxes are used as additives. Suitable surfactants, for example, are the Dehydols of Henkel on the basis of fatty alcohols and fatty alkyl polyethyleneglycol ether. Paraffin wax dispersions are used as waxes.

The dissolubility or recyclability of paper coated in such a way is based on the balance between hardness and dispersibility of the coating. These two properties can be purposefully adjusted by latex or polymers as required by the respective application. Such polymers are, for example, ethylenevinylacetate (Vinamul 33027), ethylene acrylic acid, ethylene acrylic ester, ethylene acrylic ester copolymers. The polymers improve the following properties:

Elasticity of the coating.
Adhesion paper/coating.
Inner strength of the coating.
Adhesion prime coat/top coat.
Adhesion top coat/adhesive.

A particular advantage of the method in accordance with the invention consists of the fact that the coating can be carried out in any coating machine which is commonly used in the production of paper. Hence, the coating can be made with either the air squeegee or blade as well as the revolving ductor with normal drying. The coating medium is water-based and thus free from organic solvents and chlorine compounds. Furthermore, it can be manufactured inexpensively.

Free-rosin sizing dispersions per se are known as sizing media for papers. Generally, however, they are known as internal sizing media, i.e. they are added to the paper machine before the sheet forming. Men skilled in the art were of the opinion, however, that such rosins are not suitable as coating media for coating in a coating machine, because the film-forming properties were too bad.

From the AT-B 372 432 it is known, for example, that colophonium rosins are also suitable for surface sizing if certain dispersing agents are added. However, there are no indications that paper which is resistant to water vapour is produced in this manner. This is not achieved with the method described in the AT-B 372 432, because the surface sizing is a process step which should only cause a water repellent finishing. This means that the surface tension is changed when the surface is wetted with water. For this purpose only very few tenths of $g/m^2$ of rosin are applied, which does not lead to a continuous coating.

The DE-A 24 37 656, the EP-A 37 055 and the DD-A 211 819 also describe the use of rosin sizes for paper sizing. The remarks made with respect to AT-B 372 432 apply analogously. Furthermore, the GB-A 1 604 847 relates to the surface treatment of paper with rosin-containing foams. Its purpose is also the water repellent finishing. Various additives control the frothing. However, nothing can be gained from this specification for the present invention.

Surprisingly it was noticed that not only a satisfactory formation of film can be achieved with suitable additives, but also that simultaneously a coat is achieved which is particularly repellent to water vapour.

The formation of the film is achieved at 50°–120° C. and, at the same time, the water is vaporized from the emulsion. Furthermore, the strength factors of the paper treated in accordance with the method of the invention are improved by approx. 15–20%. The gluing is possible without any problems. A dissolution of the coated paper is also possible without any problems in the pulper at material densities of approx. 3 to 15%.

It is particularly preferable if the backing paper is pigmented before the coating. In this way the required coating amount for the barrier effect can be drastically reduced. In this way it is possible to make the paper white and, at the same time, resistant to water vapour.

Alkylphenol polyethylene glycol ether can be used as additive, such as, for example, Lutensol AP from BASF. It is particularly preferable if amines are provided as further additives, e.g. triethanolamine or diethylethanolamine.

In particular, fatty amine ethoxylate can be used, such as the various types of Genamins from Hoechst. Substantially, four groups can be distinguished:

Coconut oil amines: saturated $C_8$–$C_{18}$ fatty amines, mainly $C_{12}$–$C_{14}$;

Oleylamines: mainly unsaturated $C_{18}$ fatty amines;

Stearylamines: saturated $C_{16}$–$C_{18}$ fatty amines;

Tallow fat amines: saturated and unsaturated $C_{16}$–$C_{18}$ fatty amines.

Ammonia can also be used as additive. If ammonia is added in form of a 25% solution, one obtains a highly viscous brushable clear solution with $NH_3$ additions of 1–10% and preferably 3–5%. The mixture is carried out by stirring in the ammonia water into the rosin sizing dispersion until a clear solution comes into being. The use of ammonia allows reaching a resistance to water vapour which is at least equivalent to the resistance to be gained with other additives. Such a process, however, is always connected with ammonia emissions, so that it is necessary to clean the exhaust air.

In a further variation of the invention fatty alcohols can be used as additives, such as, for example, Dehypon or Dehydol from Henkel, fatty alkyl ethoxylate, e.g. Peratom 123 from Henkel, fatty alkyl polyethyleneglycol ether with fatty acids, e.g. Dehydol HD-FC-6 from Henkel.

By adding latex, ethylenevinylacetate, ethylene acrylic acid, ethylene acrylic ester, ethylene acrylic ester copolymers it is possible to substantially reduce the brittleness and also to slightly increase the hardness.

It is particularly preferable if a filler, such as a pigment, is added to the coating medium. Particularly suitable for this purpose are platelike pigments like, for example, talcum, because the diffusion path of the water vapour is extremely lengthened. Fillers from the group of calcium carbonate, aluminium hydroxide, aluminosilicate, and titanium oxide can also be used.

It is particularly preferable if the solids content of the coating medium is 20–70%, resulting in a viscosity between 30 and 800 mPas, preferably between 50 and 300 mPas. In this manner it is possible to work with all common coating units.

It is particularly preferable if a precoating is made before the coating medium is applied. Said precoating can be carried out with the same coating medium as the actual coat. It is. however, also possible that a medium with an increased filler content is used. In this way the required amount of rosin can be minimized. In order to enable the formation of the film, a paper surface temperature of 20° to 160° C., preferably 50° to 130° C. is required. The temperature depends on the respective softening point of the rosin size which is used. An extreme resistance to water vapour can be achieved by this double coat, which is less than 20 g/m$^2$d (WVT 90%). Furthermore, such a double coat is particularly recommendable if it is not possible to apply the required coating thicknesses in one single coat.

It is particularly preferable if the precoat contains polyvinyl alcohol and, in particular, consists of a mixture of polyvinylalcohol and pigments. Furthermore, said precoat shall be subjected to a thermal treatment with temperatures between 120° C. and 170° C., preferably between 140° C. and 160° C. It has been determined that a coat with a material containing PVA has a very low permeability to water vapour through said thermal treatment. Polyvinyl alcohol is completely free from halogens and toxicologically and ecologically completely harmless. In particular, organic solvents are not required. The precoat may contain, in addition to the polyvinyl alcohol, fillers such as calcium carbonate, mica, kaoline, aluminium hydroxide, aluminosilicate, talcum, starch or titanium oxide. The coat may further contain an ethylene acrylic ester copolymer, which provides a particularly good resistance against water as well as an improved water vapour resistance.

It may also be provided that a top coat is applied in addition. It is preferable in this respect if the top coat contains polyvinyl alcohol and that said top coat is subjected to a thermal treatment with temperatures between 120° C. and 170° C., preferably between 140° C. and 160° C.

The above-mentioned advantages of coating materials containing polyvinyl alcohol also applies to the top coat. As polyvinyl alcohol is particularly resistant to water vapour in the range of low to medium humidity, whereas the coat with a free-rosin sizing dispersion is particularly preferable in the range of high moistures, the double-coated paper will always be used in such a way that the coat with the free-rosin sizing dispersion shows towards the wet side. In the case of a precoat with PVA which is covered by a coat containing free-rosin sizing dispersion, the coated side of the paper will always be oriented towards the moisture. In contrast to this, in paper containing a top coat made from PVA the coating will always show towards the dry side.

It is also possible that the water vapour diffusion barrier consists of a prime coat based on rosin (rosin size, surfactant, polyvinyl acetate, talcum) and a top coat based on PVA with pigments. This is a possible variation for the ability to glue with starch adhesives on a hydrous basis. The wetting and the adhesion of the PVA top coat on the rosin coat can be improved by a corona treatment. Thus surfactants can be left out in the PVA top coat.

The invention further relates to a paper with increased resistance to water vapour, said paper being coated by a coating medium. Such a paper is characterized in by a coating formed by a free-rosin sizing dispersion which contains additives for improving the film-forming properties, amongst which additives are surfactants or waxes, as well as preferably other additives.

DESCRIPTION OF THE PREFERRED EMBODIMENTS

The invention is now outlined in greater detail in examples.

Comparative Examples

Kraft bag paper of 70 g/m$^2$ machine-finished is used in all examples as base paper. In the first comparative example this paper is investigated uncoated. In the second comparative example this paper is laminated in the usual manner with polyethylene. The permeability to water vapour (such as WVT) in g/m$^2$ and per day is evaluated for all examples by means of two different conditions.

Example 1

The paper is coated with a coating medium of the following composition:

| | |
|---|---|
| 65% | Rosin sizing absolutely dry |
| 30% | Talcum absolutely dry (Fintalk C 10) |
| 5% | Surfactant (Dehydol HD-FC-6). |

The coating is carried out as double coating with 12 g/m² amount of coating for the first coat and 7 g/m² for the second coat.

Example 2

A coating medium with the following recipe is used:

| | |
|---|---|
| 50% | Rosin sizing absolutely dry |
| 30% | Talcum absolutely dry |
| 18% | Ethylenevinylacetate absolutely dry |
| 2% | Dehydol HD-FC-6 |

The coating is carried out as double coating with 12 g/m² amount of coating for the first coat and 7 g/m² for the second coat.

Results of the examination of water vapour permeability (WVT) in g/m² per day in accordance with DIN 53 122

| | Coating amount g/m² | WVT standard climate C 75% rel hum. 25° C. | WVT 90% rel hum. 26° C. |
|---|---|---|---|
| Comparative ex. 1 (uncoated) | 0 | 1600 | 2300 |
| Comparative ex. 2 (polyethylene lamination) | 20 | 14 | 21 |
| Example 1 | 12 + 7 | 12 | 19 |
| Example 2 | 12 + 7 | 12 | 20 |

The coating of example 2 has the advantage over the coating of example 1 in that it has a higher elasticity and thus an improved buckling resistance, whereby the inner strength of the coating is much higher.

Examples are shown below, in which a coat with a material containing polyvinyl alcohol (PVA) can substantially improve the resistance to water vapour in lower or average humidities of the air. These examples also show the effects of additives and additional prime coats and top coats.

Example 3

PVA coats are examined in example 3. For purposes of comparison uncoated paper is at first compared with paper provided with a coat made from polyvinyl alcohol and ethylene acrylic acid with a ratio 70:30. In the two columns on the right-hand side coats with the following composition are examined:

| | |
|---|---|
| 35% | Polyvinyl alcohol |
| 65% | Talcum |

Results of the examination:

| | uncoated | PVA + ethylene acrylic acid | PVA + talcum single coated | PVA + talcum double coated |
|---|---|---|---|---|
| Coating amount g/m² | 0 | 7 | 7 | 5 + 5 |
| Strength (uncoated = 100%) | 100% | 120% | 120% | 120% |
| Water vap. permeability DIN 53122, Climate C in g/m² (75% rel. hum., 25° C.) | | | | |
| Drying at 100° C., 10′ | 1600 | 100 | 186 | 150 |
| Hot air drying 120° C., 10′ | 1600 | 61 | 65 | 15 |
| Contact drying 160° C., 5″ | | 63 | 75 | 17 |

If a coating in accordance with the examples 1 and 2 with a free-rosin sizing dispersion is combined with a coating of the example 3 PVA, there is a synergistic effect, because the free-rosin sizing coating is particularly effective against high humidity of the air, whereas the PVA coating is particularly efficient in lower or average humidities of the air. It is, however, important that the coating with the free-rosin sizing dispersion is always located on the wet side and the coating with the PVA on the dry side of the paper.

Examples 4 to 7

In the example 4 the free-rosin sizing dispersion, whose composition is equivalent to that of example 2, is applied in a lower quantity.

In the example 5 a PVA coating consisting of 65% talcum and 35% PVA Mowiol 6-98 is applied, which is subjected to a thermal treatment at 140° C.

In the example 6 a free-rosin sizing dispersion prime coat is combined in accordance with example 4 with a PVA top coat in accordance with example 5.

In the example 7 a double coat with a free-rosin sizing dispersion with a coating amount of 10 g/m² is combined with a PVA coat, whereby the PVA coated side shows towards the drier climate.

Results of the trials of examples 4 to 7:

| | Coating amount g/m² | WVT standard climate C 75% rel hum. 25° C. | WVT 90% rel hum. 26° C. |
|---|---|---|---|
| Example 4 | 7 | 37 | 50 |
| Example 5 | 10 | 25 | 200 |
| Example 6 | 10 + 7 | 10 | 17 |
| Example 7 | 10 + 7 | 4 | 14 |

We claim:

1. A method of reducing the water vapor permeability of a sheet of paper, which comprises the steps of coating the paper sheet with a film of 5–30 gm/m² of a chlorine-free coating medium consisting of a rosin sizing dispersion containing additives improving the film-forming properties of the coating medium, which additives include surfactants and waxes; and applying a top coat containing polyvinyl alcohol and ethylene acrylic acid to the sheet of paper after applying the film thereto, the top coat being subjected to a thermal treatment at a temperature between 120° C. and 170° C.

2. The method of claim 1, wherein the additives include at least one additive selected from the group consisting of paraffin waxes, alkylphenol polyethylene glycol ether, fatty amines, fatty amine ethoxylate, fatty alkyl ethoxylate, fatty alkyl polyethyleneglycol ether, ammonia, and polymers of ethylenevinylacetate, and ethylene acrylic ester.

3. The method of claim 1, wherein the coating medium additionally contains a filler selected from the group consisting of kaolin, talcum, mica, calcium carbonate, aluminum hydroxide, aluminosilicate and titanium oxide.

4. The method of claim 1, comprising the further step of applying a polyvinyl alcohol containing precoat to the sheet of paper before applying the film thereto, the precoat being subjected to a thermal treatment at a temperature of 120° C. and 170° C.

5. The method of claim 4, wherein the temperature is between 140° C. and 160° C.

6. The method of claim 4, wherein the precoat additionally contains a filler selected from the group consisting of kaolin, talcum, mica, calcium carbonate, aluminum hydroxide, aluminosilicate, titanium oxide and ethylene acrylic ester copolymer.

7. The method of claim 1, wherein the temperature is between 140° C. and 160° C.

8. The method of claim 1, wherein the top coat additionally contains a filler selected from the group consisting of kaolin, talcum, mica, calcium carbonate, aluminum hydroxide, aluminosilicate, titanium oxide and ethylene acrylic ester copolymer.

9. The method of claim 8, wherein the top coat additionally contains a filler selected from the group consisting of kaolin, talcum, mica, calcium carbonate, aluminum hydroxide, aluminosilicate, titanium oxide and ethylene acrylic ester copolymer.

10. A sheet of paper having reduced water vapor permeability, comprising a coating of a film of 5–30 g/m$^2$ of a chlorine-free coating medium consisting of a rosin sizing dispersion containing additives improving the film-forming properties of the coating medium, which additives include surfactants and waxes; and a top coat containing polyvinyl alcohol and ethylene acrylic acid.

11. The sheet of paper of claim 10, wherein the additives include at least one additive selected from the group consisting of paraffin waxes, alkylphenol polyethylene glycol ether, fatty amines, fatty amine ethoxylate, fatty alkyl ethoxylate, fatty alkyl polyethyleneglycol ether, ammonia, and polymers of ethylenevinylacetate, and ethylene acrylic ester.

12. The sheet of paper of claim 10, wherein the coating medium additionally contains a filler selected from the group consisting of kaolin, talcum, mica, calcium carbonate, aluminum hydroxide, aluminosilicate and titanium oxide.

13. The sheet of paper of claim 10, comprising a polyvinyl alcohol containing precoat on the sheet of paper under the film coating.

14. The sheet of paper of claim 13, wherein the precoat additionally contains a filler selected from the group consisting of kaolin, talcum, mica, calcium carbonate, aluminum hydroxide, aluminosilicate, titanium oxide and ethylene acrylic ester copolymer.

* * * * *